US009080819B2

(12) United States Patent
Nakano et al.

(10) Patent No.: US 9,080,819 B2
(45) Date of Patent: Jul. 14, 2015

(54) FOLDED HEAT EXCHANGER WITH V-SHAPED CONVEX PORTIONS

(75) Inventors: Kimiaki Nakano, Shibuya-ku (JP); Kiyoshi Sasaki, Shibuya-ku (JP); Kouiti Akisawa, Shibuya-ku (JP); Jun Ono, Shibuya-ku (JP); Toshikatsu Hachiya, Shibuya-ku (JP); Satoshi Sakuma, Shibuya-ku (JP); Eriko Watase, Shibuya-ku (JP)

(73) Assignee: T.RAD Co., Ltd., Tokyo (JP)

( * ) Notice: Subject to any disclaimer, the term of this patent is extended or adjusted under 35 U.S.C. 154(b) by 725 days.

(21) Appl. No.: 13/253,770

(22) Filed: Oct. 5, 2011

(65) Prior Publication Data

US 2013/0087318 A1 Apr. 11, 2013

(51) Int. Cl.

| | |
|---|---|
| ***F28F 7/00*** | (2006.01) |
| ***F28D 7/10*** | (2006.01) |
| ***F28D 1/04*** | (2006.01) |
| ***F25B 39/02*** | (2006.01) |
| ***F28F 1/12*** | (2006.01) |

(52) U.S. Cl.
CPC ..... *F28F 1/126* (2013.01); *F28F 2215/00* (2013.01); *F28F 2215/04* (2013.01)

(58) Field of Classification Search
CPC ..... F28F 1/08; F28F 1/12; F28F 1/126
USPC ..... 165/80.3, 149, 151, 152; 62/515, 519, 62/523
See application file for complete search history.

(56) References Cited

U.S. PATENT DOCUMENTS

| | | | | |
|---|---|---|---|---|
| 4,376,460 | A | 3/1983 | Skoog | |
| 4,420,039 | A * | 12/1983 | Dubrovsky | 165/152 |
| 6,615,910 | B1 * | 9/2003 | Joshi et al. | 165/80.3 |
| 7,159,649 | B2 * | 1/2007 | Thyrum et al. | 165/165 |
| 2004/0177949 | A1 * | 9/2004 | Shimoya et al. | 165/152 |
| 2005/0039898 | A1 * | 2/2005 | Wand et al. | 165/167 |
| 2008/0264098 | A1 * | 10/2008 | Shikazono et al. | 62/513 |
| 2010/0071886 | A1 * | 3/2010 | Shikazono et al. | 165/151 |
| 2010/0095659 | A1 | 4/2010 | Kuroyanagi et al. | |

FOREIGN PATENT DOCUMENTS

| | | | |
|---|---|---|---|
| EP | 1912034 | A1 * | 4/2008 |
| JP | 56-102697 | | 8/1981 |
| JP | 6-30677 | | 4/1994 |
| JP | 2010-96456 | | 4/2010 |
| JP | 2011112331 | A * | 6/2011 |
| WO | WO-2008/090872 | | 7/2008 |

OTHER PUBLICATIONS

Translation of Japanese Publication JP 2011112331 A named JP2011112331, the document was translated in July of 2014.*

* cited by examiner

*Primary Examiner* — M. Alexandra Elve
*Assistant Examiner* — Paul Alvare
(74) *Attorney, Agent, or Firm* — Jordan and Hamburg LLP

(57) ABSTRACT

In a heat exchanger in which a number of V-shaped convex portions are arranged in parallel at a surface of a fin, one of a pair of inclined convex portions forming a V-shape is arranged to be inclined to a plus side by an angle a relative to a circulation direction of a gas at a first plane of a fin, the other is arranged to be inclined to a minus side by an angle b, and both of them are arranged by asymmetric angles in a left and right direction, and at a second plane opposed to the first plane, the angles which are asymmetric in the left and right direction are made to be reverse to those of the first plane relative to the circulation direction of the gas.

3 Claims, 7 Drawing Sheets

FOLDED HEAT EXCHANGER WITH V-SHAPED CONVEX PORTIONS

BACKGROUND OF THE INVENTION

The present invention relates to a heat exchanger, in particular, to a fin of a heat exchanger which is used at a location replete with sand dust, or used in a heat exchanger in which an exhaust gas of an engine circulates, and a heat exchanger in which a granulous substance of dust or the like is difficult to adhere to a surface of the fin.

The most effective method for improving the performance of a heat exchanger resides in forming a number of louvers at a surface of a fin by cutting to raise the surface.

However, according to a heat exchanger which is used at locations full of dust, or a heat exchanger in which an exhaust gas of an engine circulates, clogging is brought about at the louver, and a fin efficiency is rapidly deteriorated.

Hence, there are known various kinds of fins which are formed with recesses and protrusions or convex shapes of wave forms at surfaces of fins in place of the louver fins.

As an example thereof, Patent Document 1 described below has been proposed. According to the proposal, as shown by FIGS. 9A and 9B, a surface of a fin arranged between tubes is alternately formed with a number of W-shaped convex portions and concave portions, and a traverse section thereof is formed in a wave form. Further, angles of continuous lines of ridge portions or valley portions of the waves fall in a range of 10 degrees through 60 degrees relative to a principal flow of air. In addition, folded lines of the W in line with the principal flow of air are formed symmetrically in a left and right direction.

Further, as shown by FIG. 9A, the air flow circulates in an arrow direction relative to the W-shaped wave. Then, a number of vortex flows in directions different from each other are produced in the air flow.

Next, it is also thinkable to form a wave in a V-shape as shown in FIG. 4A by adopting a portion of the wave in the W-shape. In this case, four uniform vortex flows are formed inside each segment of a fin. The vortex flows contiguous to each other are respectively formed in directions reverse to each other.

In FIG. 4A, inclined convex portions 2*a* and 2*b* forming a V-shaped convex form are formed in angles symmetrical with each other in a left and right direction relative to a center of the air flow 5. That is, the inclined convex portion 2*a* on the left side makes an angle α relative to a center line and the inclined convex portion 2*b* on the right side makes a minus angle α.

[Patent Document 1] WO2008/090872A Publication

SUMMARY OF THE INVENTION

The inventors have confirmed by experiments that the four uniform vortex flows in FIG. 4B are stabilized, and dust, soot or the like is liable to be stagnant at boundaries of the vortex flows contiguous to each other and grows to some degree. It is apparent that by adhesion of the granulous substance, a circulation resistance of the air flow is increased, and a heat exchange performance is deteriorated.

Hence, the present invention has found by various experiments a condition of reducing the stagnation of the granulous substance as less as possible in the wave form fin having a number of convex portions of the V-shape or the W-shape, and the present invention has been completed based on the knowledge.

According to a first aspect of the present invention, there is provided a heat exchanger in which a number of fins (2) are fixed between a number of flat tubes (1) arranged in parallel, or inside the flat tubes, and a gas containing a granulous substance is made to circulate on a side of the fin (2), and in which the fin (2) has a number of v-shaped convex portions (9) folded each having a planar V-shape or a reverse V-shape toward a circulation direction of the gas, and each having a section of a wave form in the circulation direction, wherein at a first plane (4) of the fin, one (2*a*) of a pair of inclined convex portions (2*a*) and (2*b*) forming the V-shape is arranged to be inclined to a plus side by an angle α relative to the circulation direction of the gas, the other (2*b*) is arranged to be inclined to a minus side by an angle β, and both of the inclined convex portions (2*a*) and (2*b*) are arranged in asymmetric angles relative to the circulation direction; and wherein at a second plane (3) opposed to the first plane (4), both of the inclined convex portions (2*a*) and (2*b*) are arranged in asymmetric angles reverse to those of the first plane (4), the one inclined convex portion (2*a*) is arranged to be inclined to the plus side by the angle β relative to the circulation direction of the gas, and the other (2*b*) is arranged to be inclined to the minus side by the angle α.

According to a second aspect of the present invention, there is provided the heat exchanger according to the first aspect of the present invention, wherein an opening angle of the V-shaped convex portion (9) of the fin is formed to fall in a range of 40 degrees through 90 degrees, and a difference between absolute values of the angle α and the angle β of the pair of inclined convex portions (2*a*) and (2*b*) is formed to fall in a range of 3 degrees through 15 degrees.

According to a third aspect of the present invention, there is provided the heat exchanger according to the first aspect or the second aspect of the present invention, wherein the fin (2) is configured by folding a metal plate in a wave form as a whole, the V-shaped convex portion (9) is formed only at a plane which is a portion not in contact with the flat tube (1), only one of the V-shaped convex portion (9) is formed in an amplitude direction of the wave form of the fin, flat face portions (8) are formed between both edge portions in the amplitude direction and both ends of the V-shaped convex portion (9) in the plane, and edges of the both edge portions are bonded to the flat tubes (1).

In the heat exchanger of the present invention according to the first aspect, in the fin 2, a number of the pairs of inclined convex portions 2*a* and 2*b* of the V-shape are formed in angles asymmetric in the left and right direction toward the air flow 5 at the first plane 4, and at the second plane 3 opposed thereto, a number of pairs of inclined convex portions 2*a* and 2*b* are formed asymmetrically in angles reverse to the angles of the first plane 4 in the left and right direction. Thereby, inside each fin segment, two large vortex flows 6 having a large radius of rotation and two small vortex flows 7 having a small radius of rotation are respectively formed in spiral shapes. Further, the respective vortexes effect influences to each other, mixing and separating thereof are repeated, a granulous substance adhering to a surface of the fin 2 is blown off, and the heat exchanger in which clogging is inconsiderable is formed.

According thereto, when the gas is moved along the respective inclined convex portions 2*a* and 2*b* in four directions which are present inside each segment 12 of the fin 2, the four spiral vortex flows are produced. However, at an inclined convex portion having a small angle of inclination, a circulation resistance thereof is smaller than that of an inclined convex portion having a large angle of inclination, and therefore, the flow is forcible, and the larger vortex flow is produced.

As a result thereof, inside each fin segment, the two vortex flows having the large radius of rotation and the two vortex flows having the small radius of rotation are respectively formed in spiral shapes. Further, directions of rotating the two large forcible vortex flows are the same, and sizes of the four vortex flows are unbalanced. Therefore, the respective vortex flows effect influences to each other, the respective vortex flows repeat mixing and separating, respective portions of the surface of the fin are intermittently knocked, and the granulous substance is prevented from adhering thereto. Therefore, in a case of a heat exchanger used at a location replete with dust as in a construction machine or the like, or an EGR cooler in which an exhaust gas including soot flows, there is achieved an advantage of bringing about a heat exchanger maintaining an initial performance by preventing clogging of a fin.

Furthermore, according to the fin of the heat exchanger of the present invention, even when a circulation direction of an air flow to the V-shaped convex portion is in a regular direction or in a reverse direction, circulation resistances thereof substantially become the same. Therefore, even when directions of fins are partially directed reversely, an equivalent function is achieved. Even when the direction of the fin is directed erroneously, no problem is posed, and a manufacturing control is facilitated.

According to the second aspect of the present invention, the heat exchanger having the excellent heat exchange function is produced. This is because the second aspect is configured to be an optimum condition of a heat exchanger having a transverse V-shaped fin.

That is, when the opening angle of the V-shape falls in a range of 40 degrees through 90 degrees centering on about 60 degrees, the fin efficiency is maximized. When the opening angle is equal to or larger than 90 degrees and is equal to or smaller than 40 degrees, J/f showing the fin efficiency is rapidly reduced. Hence, the opening angle of degrees through 90 degrees having the excellent efficiency is selected.

Further, according to the angle of the V-shape, when the difference between the left and right asymmetric angles falls in a range of 3 through 15 degrees, in comparison with the symmetric shape V fin, the fin efficiency is generally improved. That is, although in that range, in comparison with the symmetric V fin, a heat transfer coefficient is reduced slightly within several percent, the circulation resistance is considerably reduced down to about 20%. As a result thereof, an energy saving type heat exchanger reducing a wind blowing power can be provided.

When the angle difference is equal to or smaller than 3 degrees, an energy saving effect is hardly recognized. Further, when the angle difference is equal to or smaller than 3 degrees, not only a reduction in the circulation resistance is not desired, but there is not a clogging preventing effect. Further, when the angle difference exceeds 15 degrees, the heat transfer coefficient is considerably reduced.

According to the third aspect of the present invention, at both edges in the amplitude direction of the plane of the fin 2, flat face portions 8 are formed between the both edges and both ends of the V-shaped convex portion 9, edges of the both edge portions are bonded to the flat tubes 1. Therefore, the flat face portion 8 is disposed at a corner portion of the fin. Therefore, the granulous substance can be prevented from being stagnant at respective corner portions by reducing the circulation resistance of the portion of the flat face portion 8.

BRIEF DESCRIPTION OF THE DRAWINGS

FIG. 1A is a partially broken outline perspective view showing a manufacturing procedure of the fin 2, FIG. 1B is a sectional view taken along a line B-B of FIG. 1A, and FIG. 1C is a sectional view taken along a line C-C of FIG. 1A;

FIG. 2A is a perspective view thereof, and FIG. 2B is a sectional view taken along a line B-B of FIG. 2A;

FIG. 8A shows the fin 2 of the present invention, and FIG. 8B shows the fin in FIG. 4; FIG. 9A is a sectional view of an essential portion thereof, and FIG. 9B is a sectional view taken along a line B-B of FIG. 9A.

DETAILED DESCRIPTION OF THE INVENTION

Figure 1A:
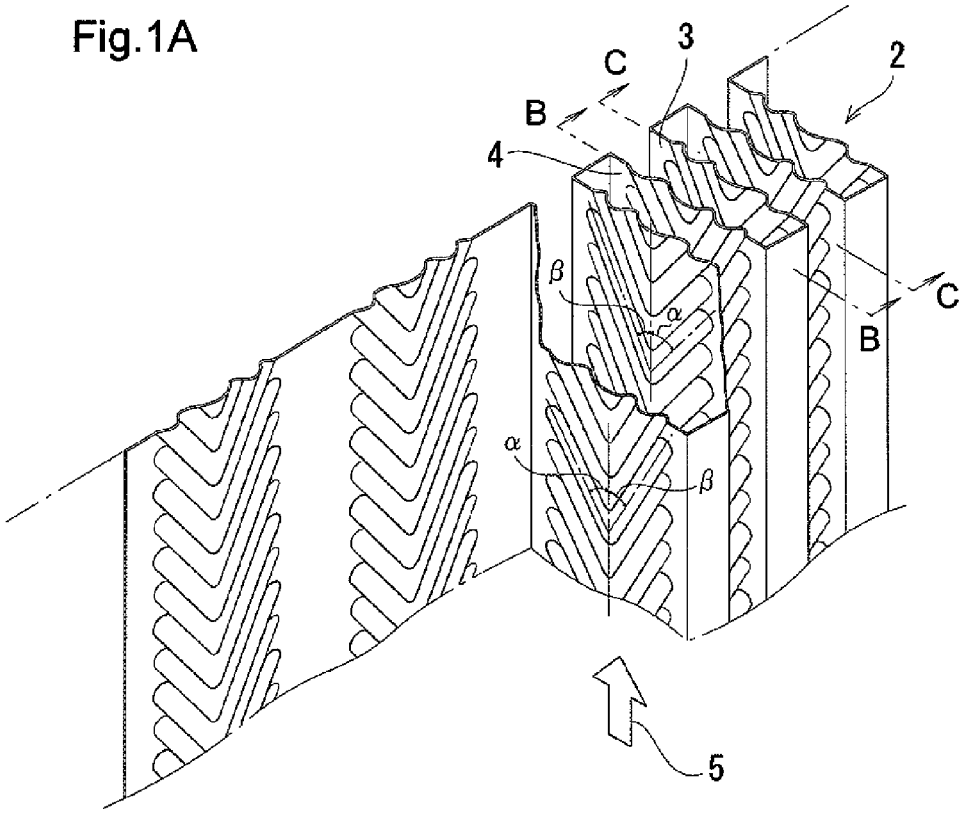
FIGS. 1A, 1B, and 1C show a fin 2.
Figure 1B:
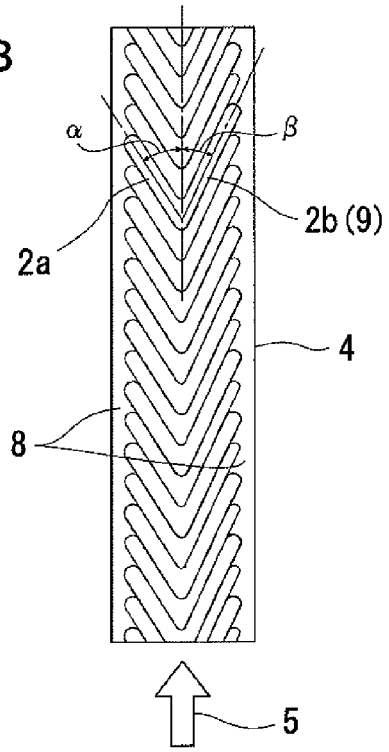
Figure 1C:
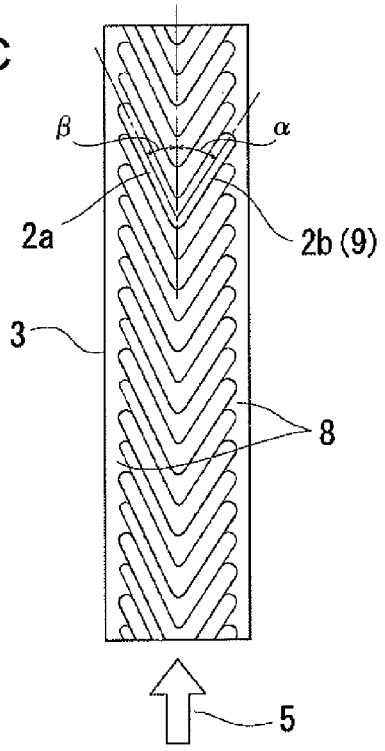

FIGS. 1A, 1B, and 1C are explanatory views of a wave form fin, FIG. 1A is an outline perspective view thereof, FIG. 1B is a plan view at a first plane 4 of FIG. 1A, and FIG. 1C is a plan view at a second plane 3 of FIG. 1A. Further, FIG. 2A is a perspective view of an essential portion of a heat exchanger, and FIG. 1B is an outline sectional view taken along a line B-B thereof.

Figure 2A:
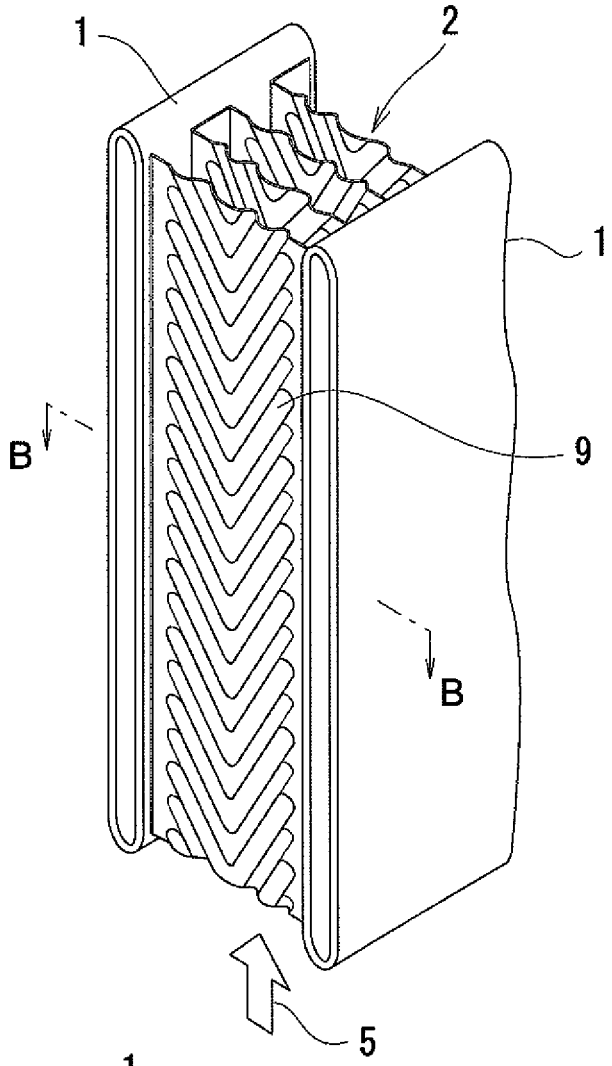
FIGS. 2A and 2B show an essential portion of a heat exchanger having the fin 2.
Figure 2B:
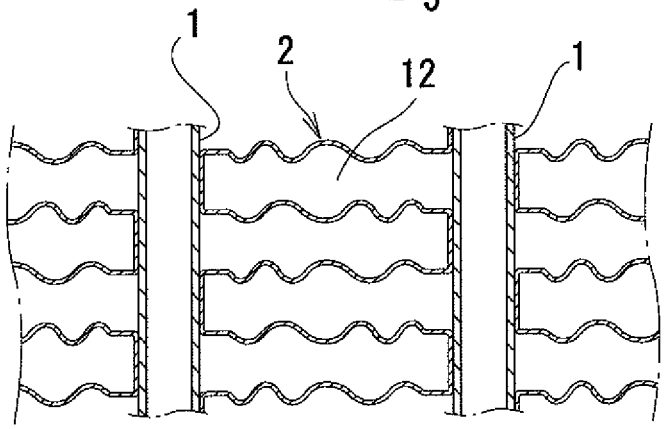

According to the heat exchanger of this example, as shown by FIGS. 2A and 2B, the wave form fins 2 are respectively brought into contact with and fixed by a number of flat tubes 1 arranged in parallel. According to the example, the fin 2 is folded to form in the shape of a rectangular wave as a whole, and a ridge portion and a valley portion of the folded portion are brazed and soldered to the flat tubes 1. Further, there are present the flat first plane 4 and the second plane 3 opposed thereto between the ridge portion and the valley portion. At the respective planes 3 and 4, a number of V-shaped convex portions 9 respectively in a V-shape diverging toward an air flow 5 are arranged in parallel in a direction of the air flow 5. A cross-sectional face (sectional face in a direction of the air flow 5) of the V-shaped convex portions 9 is folded to form in a small wave form as shown by FIG. 2B, and also a vertical sectional face (sectional face in a direction orthogonal to the air flow 5) is folded to form in a small wave form.

Further, a width of each V-shaped convex portion 9 is formed to be slightly smaller than an amplitude of the fin 2, and flat face portions 8 are formed between both ends of the V-shaped convex portions 9 and the ridge portion as well as the valley portion of the wave as shown by FIGS. 1A and 1B.

Further, at each V-shaped convex portion 9, an inclined convex portion 2*a* which is one of a pair of inclined convex portion 2*a* and 2*b* forming the V-shape at the first plane 4 is disposed in an angle α on a plus side (a left side is made to be plus) relative to a circulation direction of the air flow 5, and the other of an inclined convex portion 2*b* is formed in an angle β on a minus side. Thereby, the both inclined convex portions 2*a* and 2*b* are formed in left and right asymmetric angles relative to the center line. Further, at the second plane 3 opposed to the first plane 4, the both inclined convex portions 2*a* and 2*b* are formed in left and right asymmetric angles reverse to the left and right asymmetric angles of the first plane 4. That is, at the second plane 3, the inclined convex portion 2*a* on the left side relative to the circulation direction of a gas is arranged to be inclined by the angle β on the plus side, and the inclined convex portion 2*b* on the right side is arranged to be inclined by the angle α on the minus side.

In order to form the fins 2, as shown by FIG. 1A, groups of the left and right asymmetric V-shaped convex portions of the same shape are pressed to form at a plane of a strip-shaped metal plate at constant intervals. Successively, the metal plate may be folded in a shape of a rectangular wave or in a V-shaped wave form. As a result thereof, at the planes 3 and 4 opposed to each other, as shown by FIGS. 1B and 1C, the groups of the V-shaped convex portions are left and right asymmetric, and the asymmetric shapes are reverse to each other.

Figure 3:
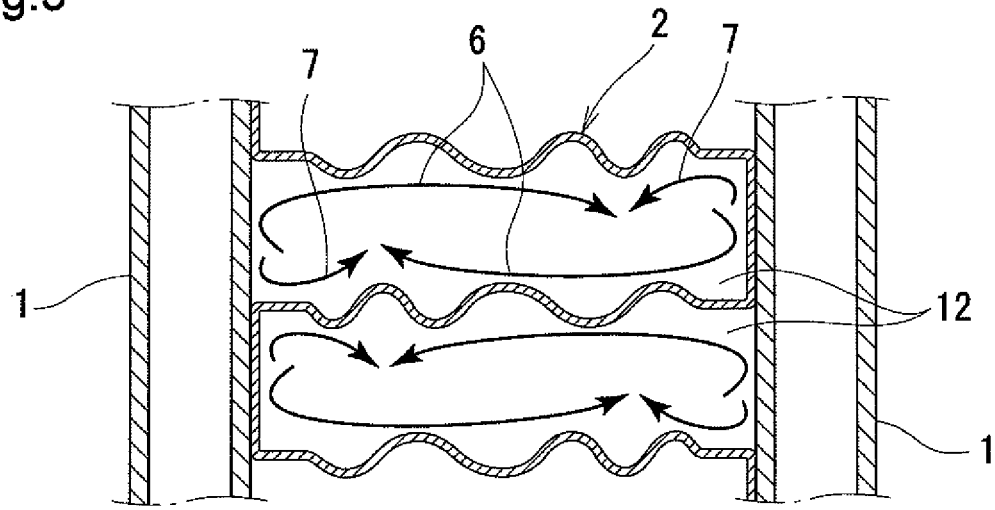
FIG. 3 is an explanatory view showing a state of forming a large vortex flow 6 and a small vortex flow 7 in a segment 12 of the fin 2 of the heat exchanger according to the present invention.

According to an experiment, by configuring the inclined convex portions respectively having the asymmetric angles reverse to each other at the first plane 4 and the second plane 3, as shown by FIGS. 1A, 1B, and 1C and FIGS. 2A and 2B, when the air flow 5 is made to circulate as shown by an arrow, at a segment 12 of each fin (space surrounded by the flat tubes 1, the first plane 4, and the second plane 3) two large vortex flows 6 and two small vortex flows 7 are formed on diagonal lines in the segment as shown by FIG. 3.

The phenomenon can be predicted to be brought about by the following reason.

When a gas is made to circulate respectively along the inclined convex portions 2*a* and the inclined convex portions 2*b* in four directions which are present inside the segment 12 of the fin 2, at the inclined convex portion having a smaller angle of inclination, a circulation resistance is smaller than that at the inclined convex portion having a larger angle of inclination, and therefore, the vortex flow is produced more forcibly. Further, the large vortex flow 6 is generated at the inclined convex portion having the smaller angle of inclination, and the small vortex flow 7 is generated at the other portion. The pair of large vortex flows 6 are formed in the same direction, and are forcible, and therefore, both of the pair of large vortex flow 6 are liable to be confluent. The large vortex flow 6 is also influenced by the small vortex flow 7, and confluence and separation of the vortex are repeated.

As a result thereof, the vortex flows are changed spatially over time in the respective segments 12 of the fin 2. As a result thereof, the granulous substance which is liable to be stagnant at the ridge portion or the valley portion of the fin is effectively blown off.

Figure 4A:
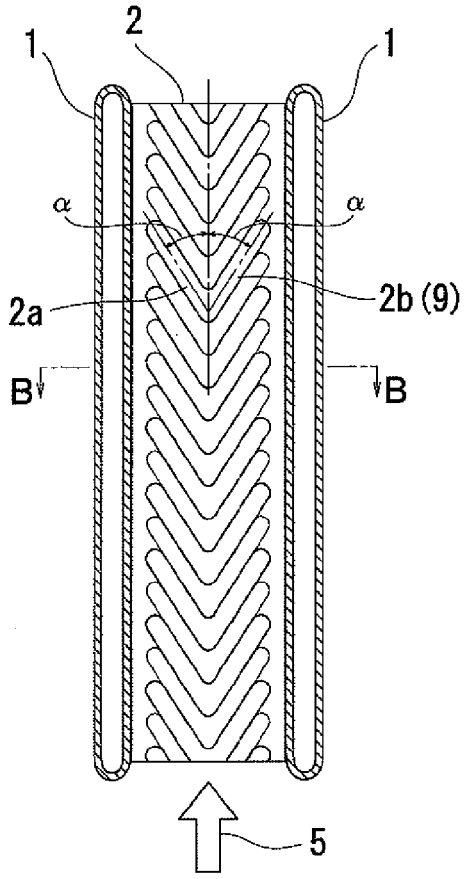
FIGS. 4A and 4B show the fin 2 for comparing with the fin of the heat exchanger according to the present invention, and a plan view of an essential portion in which a V-shaped convex portion 9 is of a symmetric shape in a left and right direction relative to an air flow 5 and an explanatory view of a vortex flow 10 at inside of the segment 12.
Figure 4B:
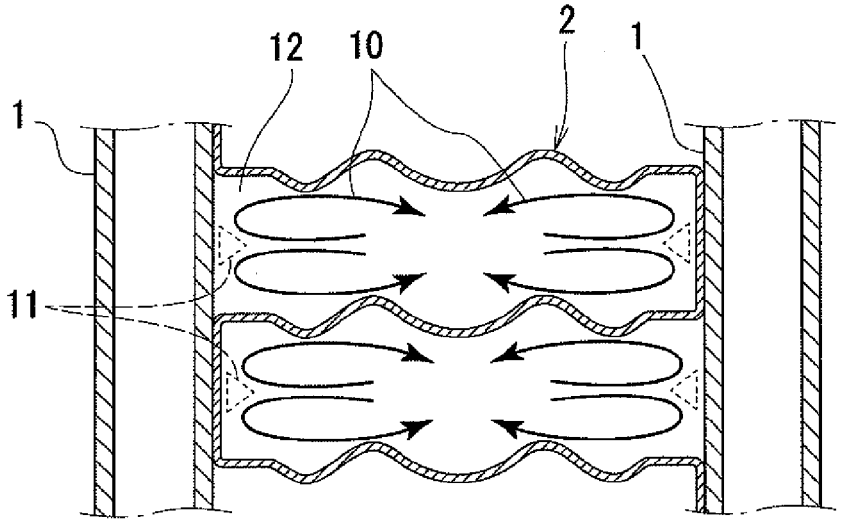

In contrast thereto, in a case of the fin 2 shown by FIG. 4A, when the inclined convex portion 2*a* and the inclined convex portion 2*b* have the angle of inclination of a symmetrically in the left and right direction relative to the air flow 5, as shown by FIG. 4B, the four uniform vortex flows 10 emerge and are stabilized. Therefore, a stagnant portion 11 is formed at a boundary thereof, at which the granulous substance of dust, soot or the like is liable to be stagnant.

Figure 5:
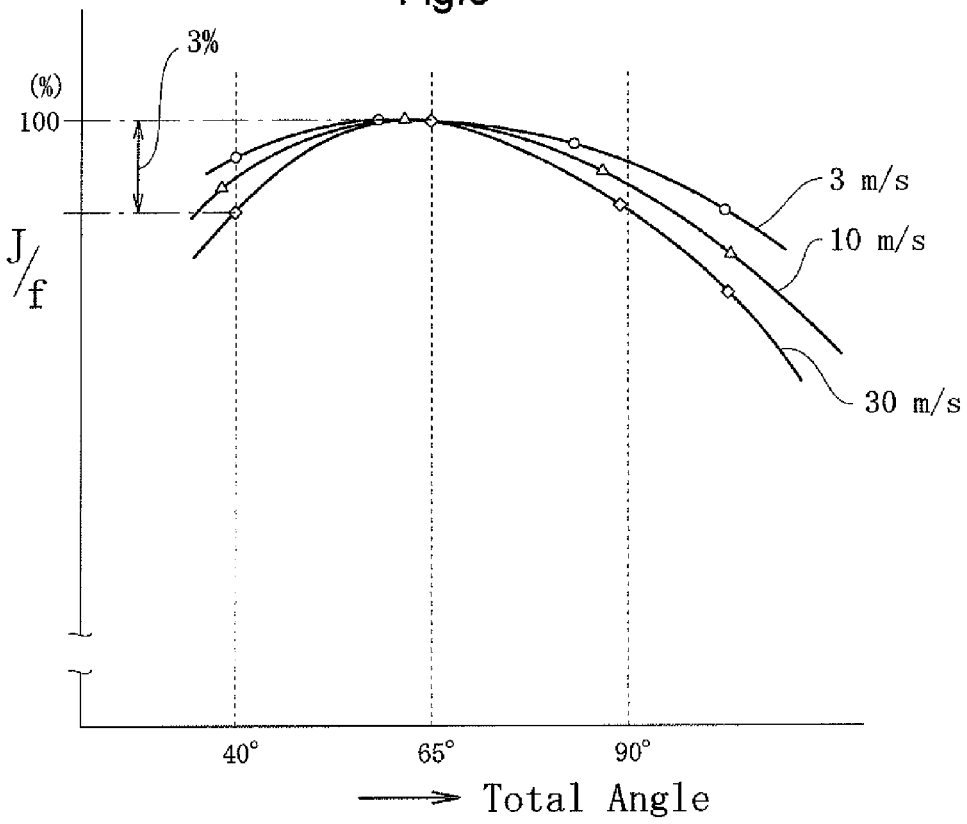
FIG. 5 is a graph showing a relationship between $\alpha+\beta$ (total angle) of the V-shaped convex portion 9 of the fin and an efficiency J/f of the heat exchanger according to the present invention.

Next, a description will be given of an optimum range of an opening angle of the V-shaped convex portion 9 of the plane of the fin 2, that is, α+β (total angle) in FIGS. 1A, 1B, and 1C. FIG. 5 shows the optimum range when a difference between absolute values of the respective angles α and β which are asymmetrical in the left and right direction is made to be nine degrees, and the total angle is changed. Further, the total angle is set to the abscissa and J/f is set to the ordinate.

The J/f is an efficiency in consideration of a balance of a heat transfer coefficient and an air resistance. Here, notation J designates Colburn number, and notation f designates a coefficient of resistance.

$$J=St\cdot Pr^{2/3}$$

$$St=Nu/(Re\cdot Pr)$$

Re=Reynolds number, Pr=Prandtl number, Nu=Nusselt number

An experiment has been carried out with a wind speed between 3 m/s through 30 m/s, and it has been confirmed by the experiment how the efficiency has been reduced by changing the total angle with regard to the total angle of the maximum efficiency at each wind speed.

As a result thereof, it has been apparent that the maximum efficiency has been achieved when the total angle falls in a range of 60 degrees through 65 degrees at any wind speed. Further, it has been found that a reduction in the efficiency within 3% has been brought about when the efficiency is maximized at any wind speed within the range of the total angle of 40 degrees through 90 degrees.

Hence, there is adopted the fin of the heat exchanger according to the present invention in which the total angle of the V-shape falls in the range of 40 degrees through 90 degrees.

Figure 6:
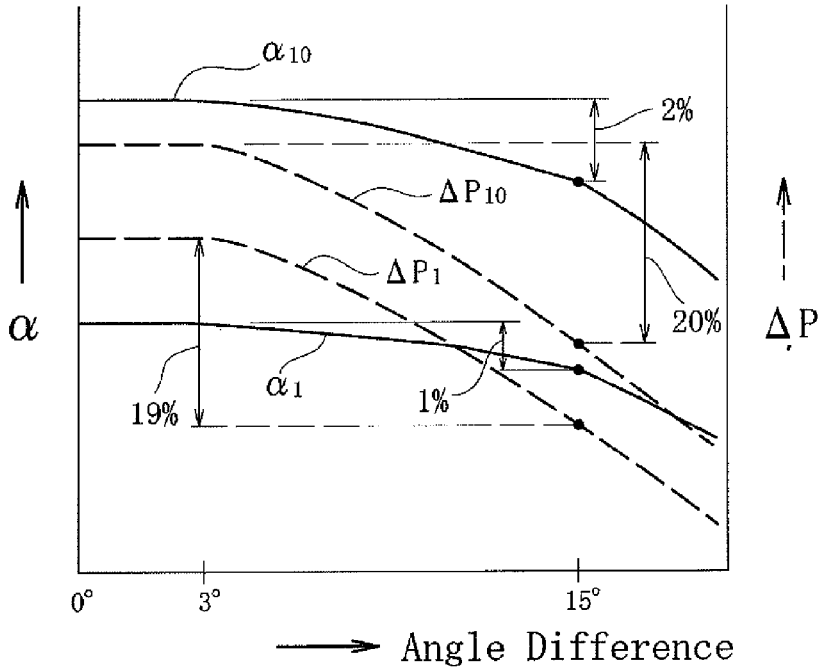
FIG. 6 is a graph showing a relationship between an angle difference between $\alpha$ and $\beta$ of the V-shaped convex portion 9 of the fin and a heat transfer coefficient $\alpha$ and a pressure loss $\Delta P$ of the heat exchanger according to the present invention.

Next, FIG. 6 shows an optimum value of a difference between angles of α and β when the total angle is set to 60 degrees of the maximum efficiency. The angle difference is set to the abscissa, and a heat transfer rate α and a pressure loss ΔP of the fin are set to the ordinate and are calculated by the experiment.

FIG. 6 shows cases in which the wind speed is set to 10 m/s and 1 m/s.

Notations $\alpha_{10}$, and $\Delta P_{10}$ described with 10 at suffixes thereof designate the heat transfer coefficient and the pressure loss at the wind speed of 10 m/s. Similarly, notations $\alpha_1$ and $\Delta P_1$ attached with 1 at the suffixes designate the heat transfer coefficient and the pressure loss at the wind speed of 1 m/s.

As a result of the experiment, as is apparent from FIG. 6, in a case of the angle difference less than 3 degrees, either of the heat transfer coefficient α and the pressure loss ΔP have remained unchanged at any wind speed. Further, when the angle difference is equal to or larger than three degrees, not only the heat transfer rate is reduced but the pressure loss ΔP is reduced. When the angle difference exceeds 15 degrees, the heat transfer coefficient α is rapidly reduced at any wind speed.

At the angle difference of 15 degrees, when the wind speed is 10 m/s, the heat transfer coefficient α is reduced from that at the angle difference 0 by 2%. At this occasion, the pressure loss is reduced from that at the angle difference 0 by 20%. It is known therefrom that the reduction in the pressure loss is larger than the reduction in the heat transfer rate in the range of the angle difference of 3 degrees through 15 degrees.

Therefore, when the angle difference is made to fall in the range of 3 degrees through 15 degrees at the wind speed of 10 m/s, the large reduction in the pressure loss (20%) can be achieved despite the small reduction in the heat transfer coefficient (2%). When the range of the angle difference is adopted for the fin of the heat exchanger, a wind blowing power of the heat exchanger can remarkably be reduced, and the general efficiency of the heat exchanger can be improved.

Similarly, even at the wind speed of 1 m/s, the large reduction in the pressure loss (19%) can be achieved despite the small reduction in the heat transfer coefficient (1%) when the angle difference falls in the range of 3 degrees through 15 degrees.

Similar results have been manifested also in a case of the wind speed of 20 m/s and in a case of the wind speed of 30 m/s. Hence, according to the present invention, the opening angle of the V-shaped convex portion 9 of the fin is made to fall in the range of 40 degrees through 90 degrees, and the difference between the absolute values of the angle $\alpha$ and the angle $\beta$ of the inclined convex portion 2*a* and the inclined convex portion 2*b* is made to fall in the range of 3 degrees through 15 degrees.

Figure 7:
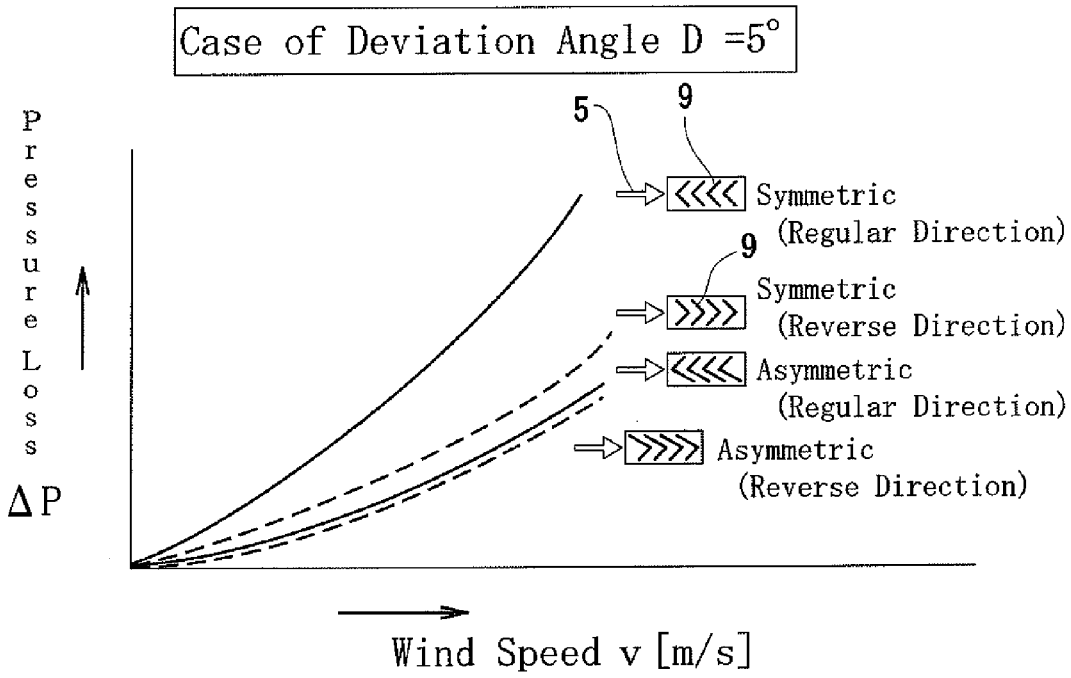
FIG. 7 is a graph showing a relationship between a wind speed of the fin and a direction and a sense of the V-shaped convex portion 9 as well as a pressure loss $\Delta P$ of the heat exchanger according to the present invention.

Next, the direction of the air flow 5 relative to the V-shaped convex portion 9 is changed in a regular direction and in a reverse direction, and pressure losses at the respective directions are measured. FIG. 7 shows an experimental result thereof. According thereto, the abscissa represents the wind speed v (m/s) and the ordinate represents the pressure loss $\Delta P$. Further, as the fins, the symmetric type fin shown in FIG. 4 and the asymmetric type fin of the present invention shown in FIG. 1 are compared.

At this occasion, the total angles of the symmetric type fin and the asymmetric type fin are set to 60 degrees.

A bold line at the topmost portion in the drawing shows a case where the V-shaped convex portion 9 is divergingly formed in the direction of the air flow 5, which is made to be the regular direction. Further, a direction reverse thereto is made to be a reverse direction.

In the case of the V-shaped convex portion 9 which is symmetric in the left and right direction and is directed in the regular direction, the pressure loss is the highest with respect to the wind speed. The second high pressure loss results in the case of the V-shaped convex portion 9 which is invariably symmetric in the left and right direction and is directed in the reverse direction. The third high pressure loss results in the case of the V-shaped convex portion 9 which is asymmetric and is directed in the regular direction as an object of the present invention. The lowest pressure loss results in the case of the V-shaped convex portion 9 which is asymmetric and is directed in the reverse direction.

As is known from FIG. 7, in the case of the fin of the heat exchanger according to the present invention which is asymmetric, there is hardly a difference between the V-shaped convex portion 9 which is directed in the regular direction of the air flow 5 and the V-shaped convex portion 9 which is directed in the reverse direction. The fact signifies that there is hardly a reduction in a heat exchange performance even when the direction of the fin 2 is made to be in the wrong direction erroneously and partially.

In contrast thereto, the pressure loss significantly differs between the case where the V-shaped convex portion 9 is installed in the regular direction relative to the air flow 5 and the case in which the V-shaped convex portion 9 is installed in the reverse direction both in the case of the symmetric type. Therefore, the wrong direction is manifested as a significant change in the performance.

Figure 8A:
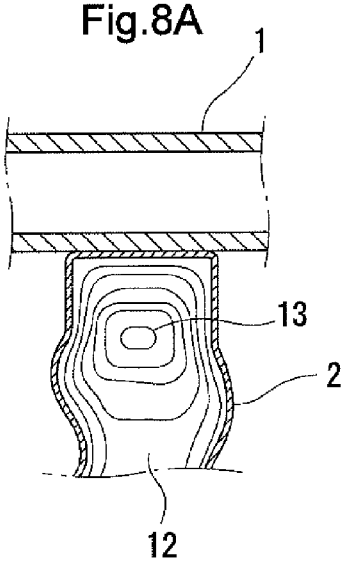
FIGS. 8A and 8B show temperature distributions in the segments 12 of the fin 2 of the heat exchangers.
Figure 8B:
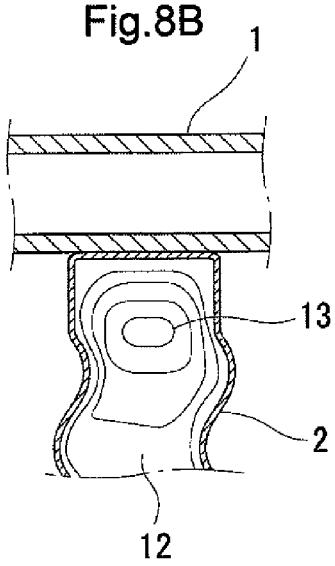
Figure 9A:
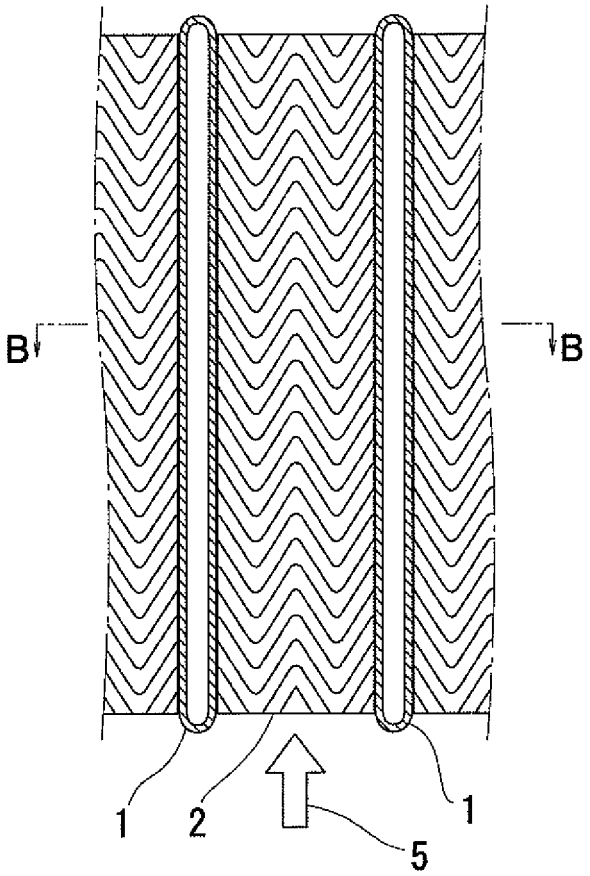
Fig.9A Prior art
FIGS. 9A and 9B show the heat exchanger having the fin 2 of a related art type.
Figure 9B:
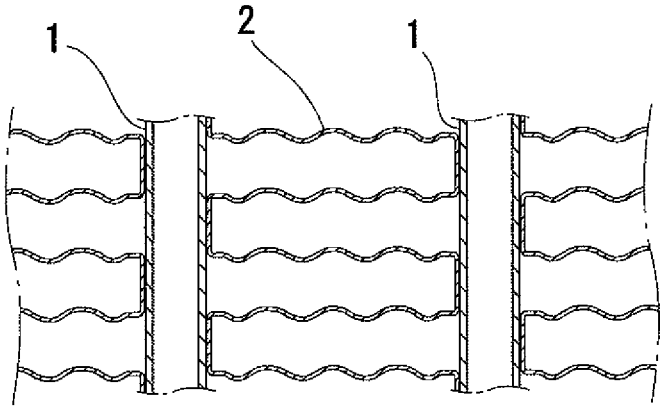
Fig.9B Prior art

Next, FIGS. 8A, and 8B show temperature distributions at an outlet end in a circulation direction of an air flow when a high temperature fluid is made to circulate inside the flat tube 1 and an air flow at an ordinary temperature is made to circulate on a side of the fin 2. Further, FIG. 8A shows a case in which the left and right asymmetric type fin 2 of the heat exchanger according to the present invention shown in FIG. 1 is used, and FIG. 8B shows an example in which the left and right symmetric type fin 2 shown in FIGS. 4A and 4B is used.

It is known from air temperature contours thereof that a range of a high temperature portion 13 is smaller in the present invention than that in FIGS. 4A and 4B. The fact signifies that the heat exchange efficiency is more excellent in the case of the fin 2 according to the present invention.

Although according to the embodiments described above, the fin is arranged at an outer face of the flat tube, the fin may be arranged at an inner face of the flat tube in place thereof. Further, a total of the fin may be folded in a shape of a rectangular wave, or may be folded in a shape of a triangular wave.

What is claimed is:

1. A heat exchanger, comprising a number of fins fixed between a number of flat tubes arranged in parallel or inside the flat tubes, and a gas containing a granulous substance is made to circulate on a side of the fin, and in which the fin has convex portions forming a number of v-shapes having a common centerline along a circulation direction of the gas, and the fin in cross section is in a shape of a wave form contour, wherein at a first plane of the fin, one of a pair of inclined convex portions forming the v-shapes is arranged to be inclined to a plus side by an angle $\alpha$ relative to the circulation direction of the gas, the other is arranged to be inclined to a minus side by an angle $\beta$, and both of the inclined convex portions are arranged in asymmetric angles relative to the circulation direction, and wherein at a second plane opposed to the first plane, both of the inclined convex portions are arranged in asymmetric angles reverse to those of the first plane, the one inclined convex portion is arranged to be inclined to the plus side by the angle $\beta$ relative to the circulation direction of the gas, and the other is arranged to be inclined to the minus side by the angle $\alpha$, and wherein an opening angle of the V-shaped convex portions of the fin is formed to fall in a range of 40 degrees through 90 degrees, and a difference between absolute values of the angle $\alpha$ and the angle $\beta$ of the pair of inclined convex portions is formed to fall in a range of 3 degrees through 15 degrees.

2. The heat exchanger according to claim 1, wherein the fin is configured by folding a metal plate in a wave form as a whole, the V-shaped convex portions are formed only at a plane which is a portion not in contact with the flat tube, only one of the V-shaped convex portions is formed in an amplitude direction of the wave form contour of the fin, flat face portions are formed between both edge portions of the plane in the amplitude direction and both ends of the V-shaped convex portions in the plane, and edges of the both edge portions are bonded to the flat tubes.

3. The heat exchanger of claim 1, wherein gas inflow occurs in a vertical direction relative to the heat exchanger, and wherein for each v-shape among the v-shapes in the first plane there is a corresponding v-shape in the opposing second plane that is vertically aligned and horizontally inverted.

* * * * *